US011136866B2

(12) United States Patent
Holodnak et al.

(10) Patent No.: US 11,136,866 B2
(45) Date of Patent: Oct. 5, 2021

(54) ELECTRONIC RELEASING MECHANISM

(71) Applicant: Hunting Titan, Inc., Pampa, TX (US)

(72) Inventors: John D. Holodnak, Spring, TX (US); Garrett M. Hohmann, Houston, TX (US); Santos D. Ortiz, Houston, TX (US); Gene McBride, Houston, TX (US); Sridhar Rajaram, Houston, TX (US); George King, Richmond, TX (US)

(73) Assignee: Hunting Titan, Inc., Pampa, TX (US)

( * ) Notice: Subject to any disclaimer, the term of this patent is extended or adjusted under 35 U.S.C. 154(b) by 36 days.

(21) Appl. No.: 16/487,799

(22) PCT Filed: Feb. 23, 2018

(86) PCT No.: PCT/US2018/019555

§ 371 (c)(1),
(2) Date: Aug. 21, 2019

(87) PCT Pub. No.: WO2018/156977

PCT Pub. Date: Aug. 30, 2018

(65) Prior Publication Data

US 2020/0248536 A1 Aug. 6, 2020

Related U.S. Application Data

(60) Provisional application No. 62/462,826, filed on Feb. 23, 2017, provisional application No. 62/515,376,
(Continued)

(51) Int. Cl.
*E21B 43/1185* (2006.01)
*E21B 43/117* (2006.01)
(Continued)

(52) U.S. Cl.
CPC ..... *E21B 43/1185* (2013.01); *E21B 17/06* (2013.01); *E21B 43/117* (2013.01);
(Continued)

(58) Field of Classification Search
CPC .... E21B 43/1185; E21B 17/06; E21B 43/117; E21B 23/00; E21B 31/00; E21B 43/119;
(Continued)

(56) References Cited

U.S. PATENT DOCUMENTS 1,315,581 A 9/1919 Scott
2,061,864 A 11/1936 Wells
(Continued)

FOREIGN PATENT DOCUMENTS

CN 104179470 A 12/2014
EP 0552087 A2 7/1993
(Continued)

OTHER PUBLICATIONS

Notification of Transmittal of the International Search Report and the Written Opinion of the International Searching Authority, PCT Application No. PCT/US18/19555, dated May 17, 2018, 10 pages.
(Continued)

*Primary Examiner* — Kristyn A Hall
*Assistant Examiner* — Jonathan Malikasim
(74) *Attorney, Agent, or Firm* — Christopher McKeon; Jason Saunders; Arnold & Saunders, LLP

(57) ABSTRACT

A releasable tool using an electronic motor to drive a differential to engage or release a quick change sub that may be coupled to additional downhole tools, such as a perforating gun string.

18 Claims, 3 Drawing Sheets

Related U.S. Application Data filed on Jun. 5, 2017, provisional application No. 62/634,018, filed on Feb. 22, 2018.

(51) Int. Cl.

| | |
|---|---|
| ***E21B 17/06*** | (2006.01) |
| ***E21B 23/00*** | (2006.01) |
| ***E21B 31/00*** | (2006.01) |
| ***E21B 43/119*** | (2006.01) |
| ***F42D 1/04*** | (2006.01) |

(52) U.S. Cl.

CPC ..... *E21B 23/00* (2013.01); *E21B 31/00* (2013.01); *E21B 43/119* (2013.01); *F42D 1/043* (2013.01)

(58) Field of Classification Search

CPC ..... E21B 23/14; E21B 31/12; E21B 43/1193; F42D 1/043

See application file for complete search history.

(56) References Cited

U.S. PATENT DOCUMENTS

| | | | | |
|---|---|---|---|---|
| 2,111,076 | A | 3/1938 | Posey | |
| 3,503,444 | A | 3/1970 | Owen | |
| 3,603,388 | A | 9/1971 | Current et al. | |
| 6,848,506 | B1 | 2/2005 | Sharp et al. | |
| 7,967,083 | B2 | 6/2011 | Hall et al. | |
| 8,230,932 | B2 * | 7/2012 | Ratcliffe | E21B 17/028 166/377 |
| 8,887,817 | B2 * | 11/2014 | Le Briere | E21B 17/06 166/377 |
| 10,060,190 | B2 * | 8/2018 | Odell, II | E21B 47/12 |
| 10,662,712 | B2 * | 5/2020 | Copold | E21B 15/045 |
| 2011/0259601 | A1 | 10/2011 | Withers | |

FOREIGN PATENT DOCUMENTS

| | | | |
|---|---|---|---|
| EP | 2381063 | A2 | 10/2011 |
| GB | 2079347 | A | 1/1982 |
| RU | 2241109 | C2 | 11/2004 |
| WO | 2004046497 | A1 | 6/2004 |
| WO | 201061231 | A1 | 6/2010 |

OTHER PUBLICATIONS

Notification of Transmittal of the International Search Report and the Written Opinion of the International Searching Authority, PCT Application No. PCT/US17/66323, dated Feb. 21, 2018, 10 pages.

Communication with Supplementary European Search Report dated Nov. 4, 2020, Application No. EP18757330, 7 pages.

Office action dated Sep. 28, 2020, Canadian Application No. 3,054,312, 3 pages.

Response to office action dated Sep. 28, 2020, Canadian Application No. 3,054,312, filed Jan. 22, 2021, 9 pages.

* cited by examiner

ELECTRONIC RELEASING MECHANISM

RELATED APPLICATIONS

This application is a 371 of International Application No. PCT/US18/19555 filed Feb. 23, 2018 which claims priority to U.S. Provisional Application No. 62/462,826, filed Feb. 23, 2017 U.S. Provisional Application No. 62/515,376 filed Jun. 5, 2017, and U.S. Provisional Application No. 62/634,018, filed Feb. 22, 2018.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, a detonator at one end of the perforating gun can detonate all of the perforating charges in the gun and continue a ballistic transfer to the opposite end of the gun. In this fashion, numerous perforating guns can be connected end to end with a single detonator detonating all of them.

The detonating cord is typically detonated by a detonator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Within a typical gun tube is a charge holder designed to hold the shaped charges. Charge holders can be formed as tubes, strips, or chains. The charge holder will contain cutouts called charge holes to house the shaped charges.

Many perforating guns are electrically activated. This requires electrical wiring to at least the firing head for the perforating gun. In many cases, perforating guns are run into the well in strings where guns are activated either singly or in groups, often separate from the activation of other tools in the string, such as setting tools. In these cases, electrical communication must be able to pass through one perforating gun to other tools in the string. Typically, this involves threading at least one wire through the interior of the perforating gun and using the gun body as a ground wire.

Perforating guns and other tools are often connected lowered or conveyed downhole while connected to the surface using a wireline. When pulling the tool back to the surface the tool string may get stuck in the borehole. If too much tension is introduced to the wireline it may fail with a part of the cable falling back into the borehole. Then a fishing tool must be used to grab the loose wireline and pull it back out. This may cause further failures and requires more use of a fishing tool. All of the wireline must be removed before a retrieval tool, such as an overshot style or wash-over style tool, can be used to pull the gun string out itself. This procedure of fishing out the tool may be costly and requires extensive time at the wellsite along with specialized tools.

Releasable tools currently in use may include explosive tools, which use a small booster type explosive to shear a neck, and shear bolts that fail at a predesigned point to allow the wireline to be pulled out of the well intact when a tool string is stuck. Issues with explosive tools may include regulatory issues, transportation issues with the explosive, and the safety concerns of having to pull a live explosive from the wellbore every time the tool string is brought to the surface. Issues with shear bolts is that they may not always fail as designed and an expensive tool may be unnecessarily lost or stuck in the wellbore as a result, or the wireline may still fail because the shear bolts do not function properly.

SUMMARY OF EXAMPLE EMBODIMENTS

An example embodiment may include an apparatus for joining and releasing downhole tools including a first cylindrical housing having a motor coupled to a driveshaft having a distal end coupled to a pinion gear, the driveshaft being partially contained in a driveshaft housing located within the first cylindrical portion housing, a second cylindrical housing having a pair of gears on a common axis, perpendicular to the axis of the second cylindrical housing, and coupled to the pinion gear, a cylindrical sleeve with an outer surface, an inner surface, and a length, surrounding a portion of the driveshaft having the majority of the outer surface electrically insulating and an electrically conductive segment along the length, wherein the electrically conductive segment corresponds to a predetermined rotational position of the driveshaft, and at least one spring mounted to the driveshaft housing and frictionally engaging to the outer surface of the cylindrical sleeve, wherein an electrical circuit is open when the at least one spring contacts the insulating majority portion of the cylinder sleeve and then closes when the at least one spring contacts the electrically conductive segment of the cylinder sleeve.

A variation of the example embodiments may include the at least one spring being a plurality of springs. The at least one spring may be electrically conductive. Each of the gears may have an inner surface facing the center axis of the second cylindrical portion, the inner surface having gear teeth on the majority portion of a first half of the inner surface and having a spiral slot on the majority portion of a second half of the inner surface. The spiral slot in the pair of gears may be designed to engage or release a fishing neck by rotating opposite directions in response to the rotation of the pinion gear on the distal end of the driveshaft. It may include a plurality of bearings within the driveshaft housing with the driveshaft located therethrough. It may include a wire connector coupled to and offset from center of the second cylindrical housing. It may include a cylindrical electrically conductive sleeve surrounding a portion of the driveshaft and having a protrusion extending outwards from the sleeve along the surface of the driveshaft. The electrically conductive segment may be a combination of the cylindrical sleeve surrounding a portion of the driveshaft and located axially adjacent to the conductive sleeve, having a slot cutout that engages to the protrusion of the conductive sleeve. The first cylindrical housing and second cylindrical housing may be electrically conductive and are electrically grounded. An electrical signal may be passed through the driveshaft. The inner surface of the cylindrical sleeve may be electrically conductive.

Another example embodiment may include a release tool for use in tool strings in oil wells including a drive unit including a motor coupled to a driveshaft, the driveshaft coupled to a gear differential, the gear differential having spiral slots engaged to a fishing neck, wherein a predetermined rotation of the motor causes the fishing neck to release from the release tool when the release tool is pulled uphole, an electrically conductive tab on the driveshaft that in conjunction with a sensor, provides rotational position data of the driveshaft to an electronics module, a sensor adapted to detect the position of the driveshaft at both extremities of its axial movement.

Further variation of the example embodiment may include the sensor being at least one spring. The at least one spring may be electrically conductive. Rotating the driveshaft causes the contact between the spring and the electrically conductive tab to contact each other, closing a circuit.

Another example embodiment may include a method for joining and releasing downhole tools including aligning a releasable tool with a quick change sub, activating a motor in a first direction to capture the quick change sub with a driveshaft coupled to a geared differential, detecting the position of the driveshaft, and confirming that the geared differential has locked the releasable tool to the quick change sub.

A variation of the example embodiment may include lowering the releasable tool into a wellbore. It may include pulling up on the releasable tool while it is in the wellbore. It may include activating the motor in a second direction to release the geared differential from the quick change sub. It may include detecting the travel of the driveshaft when releasing the quick change sub. It may include confirming that the releasable tool is fully released from the quick change sub. It may include removing the releasable tool from the wellbore.

Another example embodiment may include a releasable tool system including an apparatus for joining and releasing downhole tools including a first cylindrical housing containing a motor coupled to a driveshaft having a distal end coupled to a pinion gear, the driveshaft being partially contained in a driveshaft housing located within the first cylindrical portion housing, a second cylindrical housing coupled to and downhole from the first cylindrical housing having a pair of gears on a common axis, perpendicular to the axis of the second cylindrical housing, and coupled to the pinion gear, each of the gears having an inner surface facing the center axis of the second cylindrical portion, the face having gear teeth on the majority portion of a first half of the face and having a spiral slot on the majority portion of a second half of the face, a cylindrical sleeve with an outer surface, an inner surface, and a length, surrounding a portion of the driveshaft having the majority of the outer surface electrically insulating and an electrically conductive segment along the length, wherein the electrically conductive segment corresponds to a predetermined rotational position of the driveshaft, at least one spring mounted to the driveshaft housing and frictionally engaging to the outer surface of the cylindrical sleeve, wherein an electrical circuit is open when the at least one spring contacts the insulating majority portion of the cylinder sleeve and then closes when the at least one spring contacts the electrically conductive segment of the cylinder sleeve, and a fishing neck adaptor sub having a tapered neck with a distal end having a perpendicular pin shaped cylinder engaged into the spiral slots of the pair of gears.

A variation may include a first wire connector coupled to and offset from center of the second cylindrical housing. It may include a second wire connector coupled to and offset from the center of the fishing neck adaptor sub. It may include a kemlon boot engaging the first wire connector and the second wire connector. It may include an electronic housing with an electronics board located proximate to and uphole from the first cylindrical housing. It may include at least one or more perforating guns coupled downhole from and proximate to the quick change sub. The releasable tool may be suspended downhole by wireline. It may include a cylindrical electrically conductive sleeve surrounding a portion of the driveshaft and having a protrusion extending outwards from the sleeve along the surface of the driveshaft. It may include the electrically conductive segment being a combination of the cylindrical sleeve surrounding a portion of the driveshaft and located axially adjacent to the conductive sleeve, having a slot cutout that engages to the protrusion of the conductive sleeve. The first cylindrical housing and second cylindrical housing may be electrically conductive and electrically grounded. An electrical signal may be passed through the driveshaft. The inner surface of the cylindrical sleeve may be electrically conductive.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
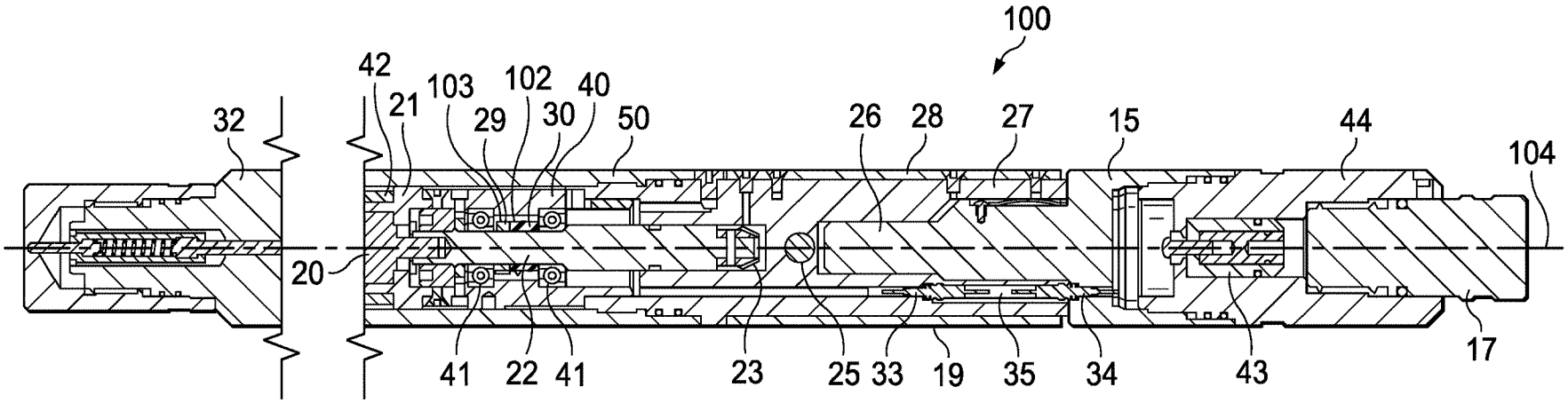
FIG. 1 depicts a cross-sectional side view of an example embodiment.

FIG. 1 depicts a cross-sectional side view of an example embodiment along a common center axis 104. The releasable tool assembly 100 has a top sub 32 coupled to a drive housing 50. The drive housing 50 contains a motor 20 held in place by a combination of a motor flange 21 in a motor housing 42. The motor 20 is coupled to a driveshaft 22. The driveshaft 22 is held in place by bearing set 41. In between the bearing set 41 is a cylindrical contact sleeve 29 having outer surface 103 that circumscribes the driveshaft 22. Adjacent axially to the cylindrical contact sleeve 29 on the driveshaft is a cylindrical insulator sleeve 30 having outer surface 102 that circumscribes the driveshaft 22. The contact sleeve 29 is composed of an electrically conductive material while the insulator sleeve 30 is composed of a material that is electrically insulating. The cylindrical contact sleeve 29 has a protrusion that engages into a slot in the insulator sleeve 30. One or more ground springs 31 are spring loaded against the outer cylindrical surface of the insulator sleeve 30. As driveshaft 22 rotates, the protrusion from contact sleeve 29 will make electrical contact with the one or more ground springs 31 (shown in FIGS. 2, 3A, 3B, and 4). The drive housing 50 is electrically conductive and acts as a ground. An electrical signal is sent through the driveshaft 22. Grounding out the signal through the ground springs 31 to the housing 50 closes a circuit. This will allow an electrical signal to be sent either uphole to the surface, or to onboard electronics, providing position information of the driveshaft 22. In an alternative embodiment the insulator sleeve 30 could have an electrically conductive segment in the same place as the protrusion.

The driveshaft 22 has a distal end coupled to a pinion gear 23. The distal end of the driveshaft 22 is located in the gear sub 27, which is coupled to housing 40 and the drive housing 50. Within the gear sub 27 is a geared differential comprising a two opposing gears 24 (shown in FIGS. 2, 3A, 3B, and 4) along a common shaft 25. The gears 24 each have a face with a portion having geared teeth designed to engage the pinion gear 23. A portion of the face of gears 24 has a spiral or spiral slot that is adapted to engage a fishing neck 26. Fishing neck is affixed to the fishing neck adaptor sub 15. Gear cover 28 contains the gear sub 27. Bottom sub 44 is coupled to the fishing neck adaptor sub 15. In this description a protector 17 is shown coupled to the bottom sub 44. The bottom sub 44 also contains the electrical go-box contacts 43 for use with further downstream tools and equipment. In these examples a fishing neck 26 and a fishing neck adaptor sub 15 are referenced, but a quick change sub may also be adapted to interface with the gear sub 27 or be coupled downhole from the fishing neck adaptor sub 15.

Electrical connector 33 is coupled to the gear sub 27. A thru hole is used to run a wire through the gear sub, off center from the axis of the tool. The electrical connector 37 is mated to a second electrical connector 34 coupled to the fishing neck adaptor sub 15 via a kemlon boot 35. This configuration allows for simple connecting and disconnecting of the electrical signal line between the release tool 19 and further downhole tools. In the event that the release tool 19 releases the fishing neck adaptor sub 15, the kemlon boot 35 will detach from one or both electrical connectors 33 and 34.

Figure 2:
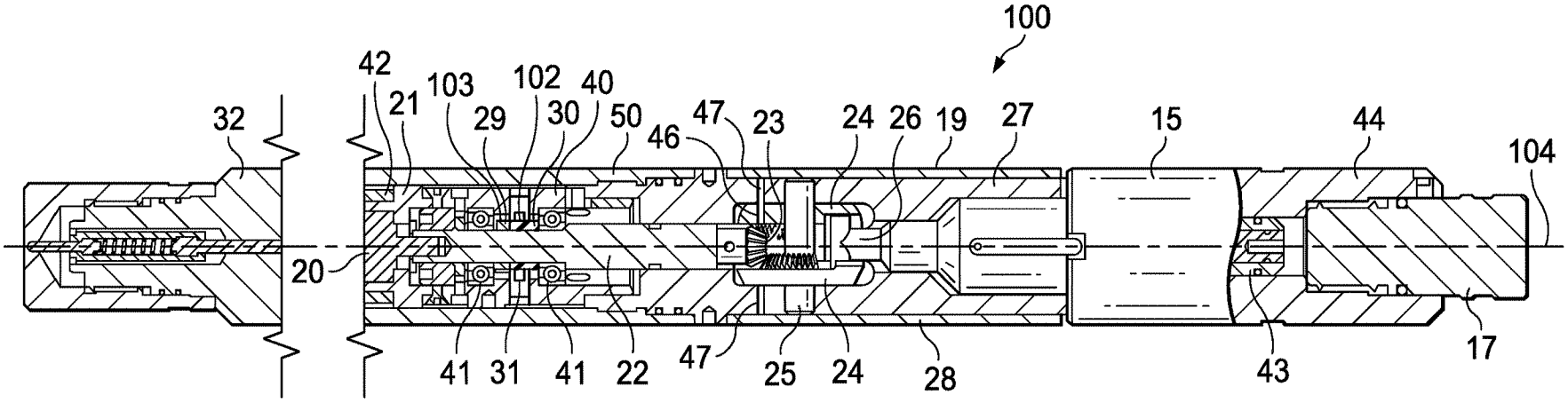
FIG. 2 depicts a cross-sectional side view of an example embodiment with the section plane rotated 90 degrees about the center axis.

FIG. 2 depicts a cross-sectional side view of an example embodiment with the section plane rotated 90 degrees about the center axis. The releasable tool assembly 100 has a top sub 32 coupled to a drive housing 50. The drive housing 50 contains a motor 20 held in place by a motor flange 21 within a motor housing 42. The motor 20 is coupled to a driveshaft 22. The driveshaft 22 is held in place by bearing set 41. In between the bearing set 41 is a cylindrical contact sleeve 29 that circumscribes the driveshaft 22. Adjacent axially to the cylindrical contact sleeve 29 on the driveshaft is a cylindrical insulator sleeve 30 that circumscribes the driveshaft 22. The contact sleeve 29 is composed of an electrically conductive material while the insulator sleeve 30 is composed of a material that is electrically insulating. The cylindrical contact sleeve 29 has a protrusion that engages into a slot in the insulator sleeve 30. One or more groundsprings 31 are spring loaded against the outer cylindrical surface of the insulator sleeve 30. As driveshaft 22 rotates, the protrusion from contact sleeve 29 will make electrical contact with the one or more groundsprings 31. This will allow an electrical signal to be sent either uphole to the surface, or to onboard electronics, providing position information of the driveshaft 22.

The driveshaft 22 has a distal end coupled to a pinion gear 23. The distal end of the driveshaft 22 is located in the gear sub 27, which is coupled to housing 40 and the drive housing 50. Drive housing 50 and housing 40 make up the release tool 19. Within the gear sub 27 is a geared differential comprising a two opposing gears 24 along a common shaft 25. The gears 24 each have a face with a portion having geared teeth designed to engage the pinion gear 23. A portion of the face of gears 24 has a spiral or spiral slot that is adapted to engage a fishing neck 26. Fishing neck is affixed to the fishing neck adaptor sub 15. Gear cover 28 contains the gear sub 27. Bottom sub 44 is coupled to the fishing neck adaptor sub 15. In this description a protector 17 is shown coupled to the bottom sub 44. The bottom sub 44 also contains the electrical go-box contacts 43 for use with further downstream tools and equipment.

Gear sub 27 has pin holes 46 that line up with corresponding pin holes 47 in the gears 24. When the tool is assembled the fishing neck 26 is engaged to the gears 24. The gears 24 are then pinned in place to the gear sub 27 as the tools is further assembled. The pins are removed prior to final assembly and lowering the tool downhole.

Figure 3B:
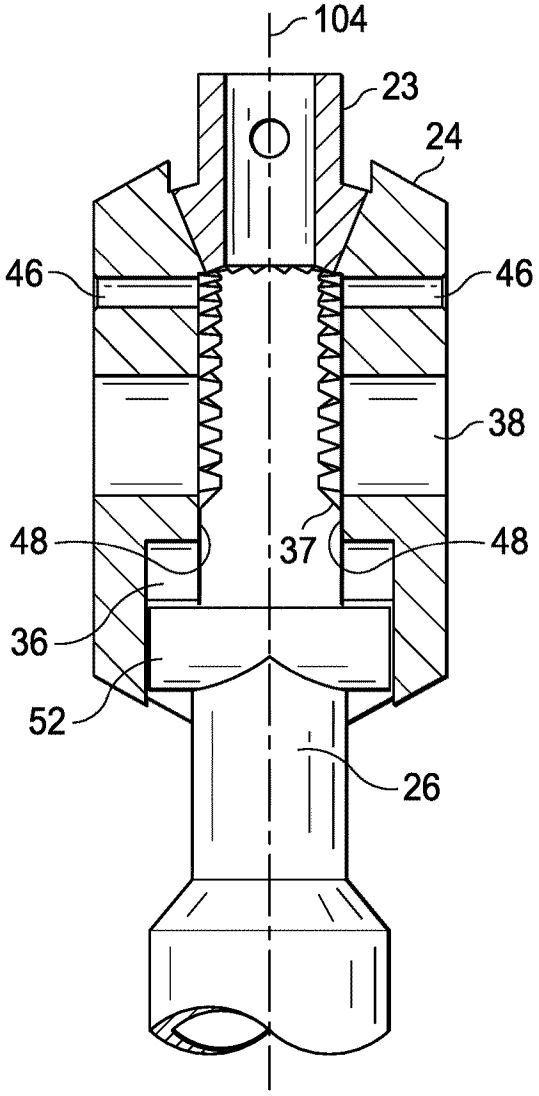
FIG. 3B is a cross-sectional side view of a differential, showing two differential gears, a pinion, and the top portion of a fishing neck.
Figure 3A:
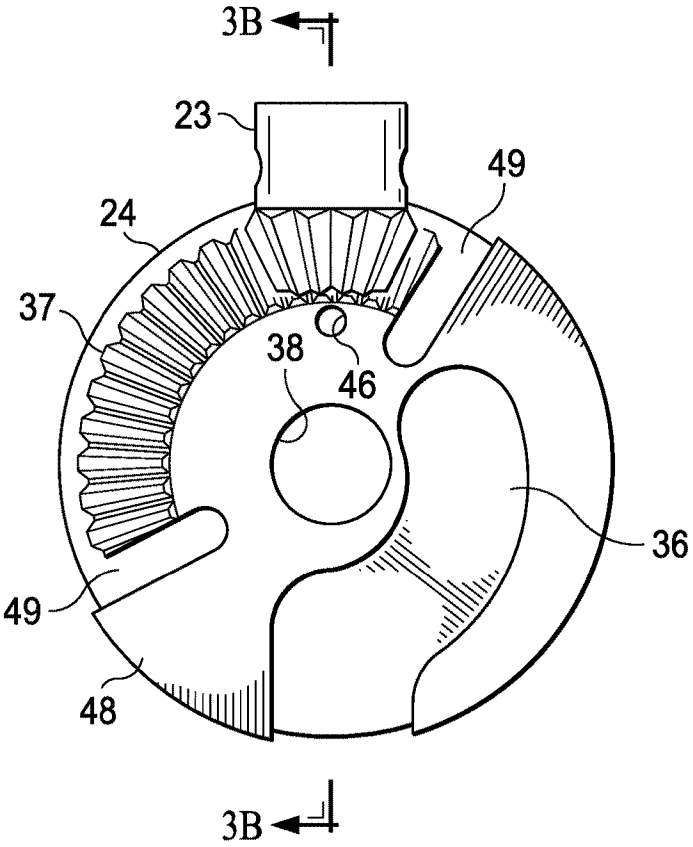
FIG. 3A is a view of one side of a differential, showing the gear and the pinion.

FIG. 3A is a view of one side of a differential, showing the gear 24 engaged with the pinion 23. The inner face 48 of the gear 24 has a portion that has gear teeth 37. The inner face 48 of the gear 24 has a portion that is a spiral shaped slot 36. The gear 24 has a thru hole 38 that allows it to rotate about a shaft or pin. The pin hole 46 allows for locking the gear 24 into place using a pin during installation. The slot 36 is adapted to engaged a cylindrical-shaped protrusion from a fishing neck and lock it into place as the gear turns, in this example clockwise. Reliefs 49 provide positive stopping locations with gear 24 with respect to pinion 23.

FIG. 3B is a cross-sectional side view of a differential, showing two differential gears, a pinion, and the top portion of a fishing neck. The gears 24 are engaged with the pinion 23 and with the fishing neck 26. The inner face 48 of the gear 24 has a portion that has gear teeth 37. The inner face 48 of the gear 24 has a portion that is a spiral shaped slot 36. The gear 24 has a thru hole 38 that allows it to rotate about a shaft or pin. The pin hole 46 allows for locking the gear 24 into place using a pin during installation. The slot 36 is adapted to engaged a cylindrical-shaped protrusion from a fishing neck and lock it into place as the gear turns, in this example clockwise. As the pinion gear 23 rotates, the gears 24 will counter-rotate with respect to each other. This causes the slots 36 to capture or release the cylindrical t-shaped end 52 of fishing neck 26, depending on which direction the pinion gear 23 rotates.

Figure 4:
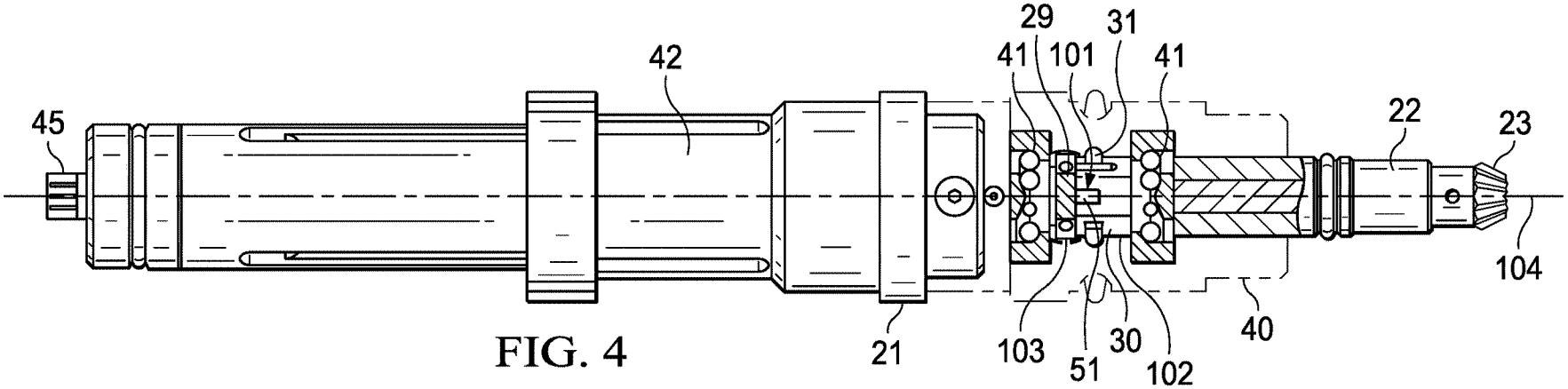
FIG. 4 depicts a side view of a motor drive sub-assembly.

FIG. 4 depicts a side view of a motor drive sub-assembly. The motor housing 42 contains a motor flange 21 containing the motor coupled to the driveshaft 22. Electricity and electrical signaling is provided via electrical connector 45, with the exterior metallic bodies of the tool assembly used as the electrical ground. The driveshaft 22 is held in place with bearings 41. In between bearings 41 is a contact sleeve 29 circumscribing the driveshaft 22 and an insulator sleeve 30 circumscribing the driveshaft 22. The distal end of the driveshaft 22 is coupled to pinion gear 23. One or more ground springs 31 are coupled on one end to the housing 40 and are in contact with the outer surface 102 of insulator sleeve 30 on the other end. The ground springs 31 stay in continuous contact with the insulator sleeve 30 as it rotates. The contact sleeve 29 has an outer surface 103 and has a protrusion 51 that engages with a slot 101 in the insulator sleeve 30, thus engaging the insulator sleeve 30 and the contact sleeve 29 together. As the contact sleeve 29 and insulator sleeve 30 rotate with the driveshaft 22, the electrically conductive ground springs 31 close a circuit each time they make contact with the outer surface 103 of the protrusion 51. This information can be interpreted by on-board electronics or at the surface as position indications of the differential gear. From this information a determination can be made whether the fishing neck has been fully engaged, partially engaged, or fully disengaged. In these examples the protrusion can also be referred to as a tab. Also, a single cylindrical sleeve could be used instead of two sleeves comprising a contact sleeve 29 and an insulator sleeve 30, the single sleeve would have a majority of its outer surface electrically insulating and then have one or more segments where an electrically conductive segment existed to close the circuit.

Figure 5:
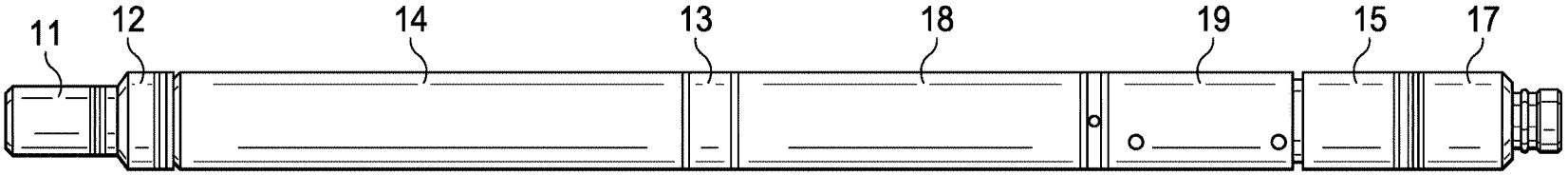
FIG. 5 depicts a side view of an example embodiment assembled.

FIG. 5 depicts a side view of an example embodiment assembled. On the uphole end there is a thread protector 11 coupled to a top sub 12. The top sub 12 is uphole from and coupled to an electric housing 14. The electric housing 14 is uphole from and coupled to the drive assembly 18 via a coupler sub 13. The drive assembly 18 is uphole from and coupled to the gearbox assembly 19. The gearbox assembly 19 is uphole from and coupled to the fishing neck adaptor sub 15. The fishing neck adaptor sub 15 is uphole from and coupled to the bottom sub 17.

During operation the release tool assembly 100 is made up at the surface. The fishing neck 26 is coupled to the gears 24. Sometimes a pin is used in pin holes 46 to lock the fishing neck 26 in place during assembly, but it is removed prior to putting the tool downhole. A computer command at the surface, through the electronics in the electric housing, command the motor 20 to rotate until the drivetrain (which may be coupled to the motor 20 with a large reduction gear ratio) reaches a predetermined point that indicates the spiral slots 36 have fully engaged the fishing neck 26. The indication to the electronics or to the operator at the surface that the release tool 19 is fully engaged occurs when one of the ground springs 31 encounters the conductive protrusion 51 and complete an otherwise open circuit. The tool assembly 100 is connected to many downhole tools, including wireline logging tools, perforating guns, and bridge plugs. The tool assembly 100 is lowered into the borehole for oilfield service work. If the tool becomes stuck for whatever reason, a decision can be made to leave the stuck tool in place by activating the release tool 19. A command from the surface to the electronics in the tool assembly will cause motor 20 to rotate driveshaft 22 until the gears 24 fully disengage from the fishing neck 26. The tool signals that it is fully disengaged when the protrusion 51 makes contact with a second ground spring, closing an otherwise open circuit, which indicates a predetermined position has been reached on the driveshaft that corresponds to the fishing neck 26 being released. At this point the operator can safely pull the rest of the tool assembly 26 out of the well, without damaging the wireline. A follow-up operation can go downhole to retrieve the rest of the stuck tool.

One of the potential benefits in using an electronically releasable tool using a wireline is that an operator does not have to break a wireline connection when pulling up on a stuck tool and then fish out the broken wireline. Instead, the operator could simple decide to release the tool based on the amount of tension already in the wireline, without shearing any component. The releasable tool can then release from the stuck tool string, thus preserving the wireline. Afterwards a retrieve tool, such as an overshot style fishing tool (a tool that grabs the stuck tool) or wash-over tool (a pipe that covers a portion or all of the stuck tool string) as examples, may be used to retrieve the stuck tool string. Since the operator will have a positive signal from the indicator switch that the collet arms are fully engaged, fully disengaged, or neither, the operator will be able to make a more informed decision on how to remove a stuck tool string.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. An apparatus for joining and releasing downhole tools comprising: a first cylindrical housing having a motor coupled to a driveshaft having a distal end coupled to a pinion gear, the driveshaft being partially contained in a driveshaft housing located within the first cylindrical housing;

a second cylindrical housing having a pair of gears on a common axis, perpendicular to a center axis of the second cylindrical housing, and coupled to the pinion gear; an electrically insulating cylindrical sleeve surrounding a portion of the driveshaft, the electrically insulating cylindrical sleeve having a slot containing a protrusion of an electrically conductive cylindrical sleeve, wherein the electrically conductive protrusion corresponds to a predetermined rotational position of the driveshaft; and at least one spring mounted to the driveshaft housing and frictionally engaging to an outer surface of the electrically insulating cylindrical sleeve or an outer surface of the electrically conductive cylindrical sleeve, wherein an electrical circuit is open when the at least one spring contacts the insulating majority portion of the electrically insulating cylinder sleeve and then closes when the at least one spring contacts the electrically conductive of the cylinder sleeve.

2. The apparatus of claim 1 wherein the at least one spring is a plurality of springs.

3. The apparatus of claim 1 wherein the at least one spring is electrically conductive.

4. The apparatus of claim 1 wherein each of the gears an inner surface facing the center axis of the second cylindrical housing, the inner surface having gear teeth on the majority portion of a first half of the inner surface and having a spiral slot on the majority portion of a second half of the inner surface.

5. The apparatus of claim 4 further wherein the spiral slots in the pair of gears are designed to engage or release a fishing neck by rotating in opposite directions in response to the rotation of the pinion gear on the distal end of the driveshaft.

6. The apparatus of claim 1 comprising a plurality of bearings within the driveshaft housing with the driveshaft located therethrough.

7. The apparatus of claim 1 further comprising a wire connector coupled to and offset from the center axis of the second cylindrical housing.

8. The apparatus of claim 1 wherein the first cylindrical housing and second cylindrical housing are electrically conductive and are electrically grounded.

9. The apparatus of claim 1 wherein an electrical signal is passed through the driveshaft.

10. The apparatus of claim 1 wherein an inner surface of the cylindrical sleeve is electrically conductive.

11. A release tool for use in tool strings in oil wells comprising:

a drive unit including a motor coupled to a driveshaft, the driveshaft coupled to a gear differential, the gear differential having spiral slots engaged to a fishing neck, wherein a predetermined rotation of the motor causes the fishing neck to release from the release tool when the release tool is pulled uphole;

an electrically conductive tab on the driveshaft that in conjunction with a sensor, provides rotational position data of the driveshaft to an electronics module;

the sensor adapted to detect the position of the driveshaft at both extremities of its axial movement.

12. The apparatus of claim 11 wherein the sensor is at least one spring.

13. The apparatus of claim 12 wherein the at least one spring is electrically conductive.

14. The apparatus of claim 13 wherein as the driveshaft rotates the contact between the spring and the electrically conductive tab closes a circuit.

15. The apparatus of claim 11 wherein the gear differential includes two gears each having an inner surface facing a center axis of the drive unit, the inner surface having gear teeth on the majority portion of a first half of the inner surface and having the spiral slot on the majority portion of a second half of the inner surface.

16. The apparatus of claim 15 wherein the spiral slots in the pair of gears are designed to engage or release the fishing neck by rotating in opposite directions in response to the rotation of a pinion gear on the distal end of the driveshaft.

17. The apparatus of claim 11 comprising a pinion gear coupling the driveshaft to the gear differential.

18. The apparatus of claim 11 further comprising a wire connector coupled to and offset from a center of the drive unit.

* * * * *